United States Patent [19]

Takada

[11] 4,384,781

[45] May 24, 1983

[54] IMAGE INFORMATION RECORDING DEVICE

[75] Inventor: Yusaku Takada, Tokyo, Japan

[73] Assignee: Canon Kabushiki Kaisha, Tokyo, Japan

[21] Appl. No.: 149,428

[22] Filed: May 13, 1980

[30] Foreign Application Priority Data

May 17, 1979 [JP] Japan ..... 54-60795

[51] Int. Cl.[3] ..... G03G 15/20; H05B 1/00

[52] U.S. Cl. ..... 355/3 FU; 219/216; 118/60; 271/273; 430/60

[58] Field of Search ..... 355/3 FU, 14 FU; 219/216, 388, 469, 470; 118/60; 100/93 RP, 155 R, 176; 271/273, 274, 308, 311; 430/98, 99; 432/60, 228

[56] References Cited

U.S. PATENT DOCUMENTS 3,440,944 4/1969 Endermann et al. ..... 219/216 X
3,997,262 12/1976 Doi et al. .
4,110,068 8/1978 Brown et al. ..... 430/60
4,121,089 10/1978 Bishop ..... 219/216
4,184,063 1/1980 Heiling et al. ..... 219/216
4,284,345 8/1981 Sugiyama et al. .
4,285,295 8/1981 Iwao et al. ..... 355/3 FU X

*Primary Examiner*—G. Z. Rubinson
*Assistant Examiner*—Keith E. George
*Attorney, Agent, or Firm*—Fitzpatrick, Cella, Harper & Scinto

[57] ABSTRACT

An image information recording device having a pair of image fixing rollers which hold a toner image bearing member between them under pressure to fix a toner image thereon during conveyance of the same, a toner-image-bearing-member-discharging-path-forming device disposed at a position subsequent to the pair of image fixing rollers with respect to a moving path of the toner image bearing member, a disengaging device to disengage, depending on necessity, the discharging path formation by the toner-image-bearing-member-discharging-path-forming device, and a device for decreasing a pressure between the pair of fixing rollers or separating the same in association with the disengagement of the discharging path formation.

27 Claims, 6 Drawing Figures

IMAGE INFORMATION RECORDING DEVICE

BACKGROUND OF THE INVENTION

This invention relates to a recording device such as, for example, an electrophotographic device, a magnetic photographic device, and other electrostatic recording devices for recording a desired image information as a toner image. More particularly, the invention is concerned with improvements in an image information recording device provided with the so-called roller type image fixing device which conveys a toner image bearing member carrying thereon a non-fixed toner image by holding the same between a pair of rollers under pressure, and fixes the toner image onto the image bearing member by heat and/or pressure during the conveyance.

It has been well known that, when the toner image bearing member gets blocked at this portion of the image fixing device, while it is being held under pressure between a pair of the image fixing rollers, the pressure exerted between the pair of rollers to this image bearing member is released to facilitate removal of the image bearing member. Since, however, the neighboring area of the pair of image fixing rollers, in particular, an image bearing member discharging path after this pair of rollers is constructed by disposing various fairly complicated means in a narrow space, it is still difficult to remove the image bearing member only by releasing the pressure between this pair of the image fixing rollers, on account of which there inevitably occur various troubles such that, for example, a part of the image bearing member remains within the image fixing device as the result of its breakage, or a part of the image bearing member conveying means is impaired or damaged at the time of the removing work.

SUMMARY OF THE INVENTION

It is therefore a principal object of the present invention to provide an image information recording device capable of easily removing a toner image bearing member when it gets clogged within an image fixing device.

DETAILED DESCRIPTION OF PREFERRED EMBODIMENT

Figure 1:
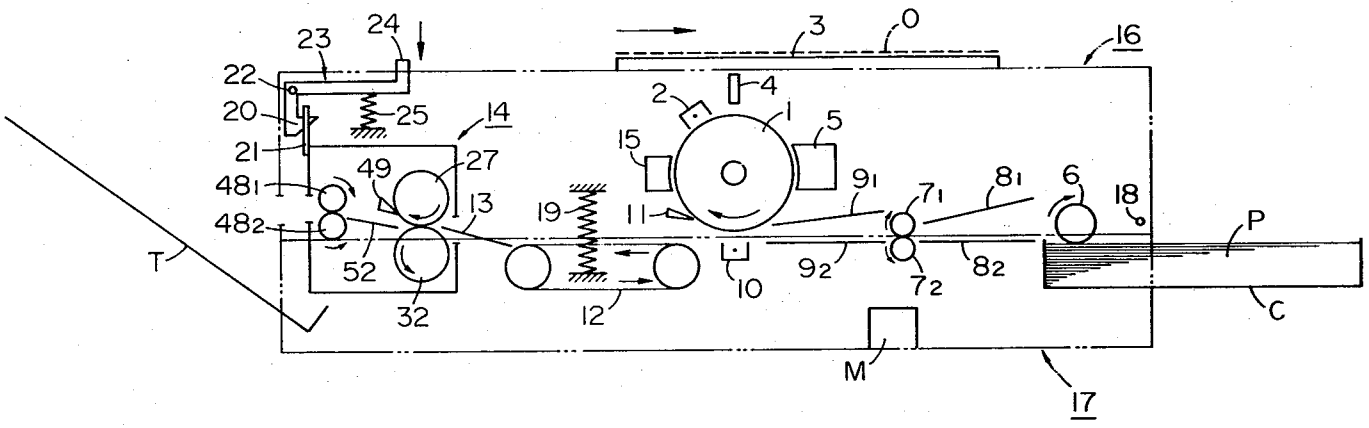
FIG. 1 is a schematic side elevational view, in cross-section, of one embodiment of the image information recording device according to the present invention which is in a state of being operable for reproduction.

Referring to FIG. 1, a numeral 1 refers to a drum having an electrophotosensitive member around its peripheral surface and which is rotatable in the arrow direction. This electrophotosensitive membr is charged by a corona discharger 2 during its rotation, after which a light image of an original for reproduction which is mounted on an image original mounting table 3 moving in the arrow direction in synchronism with rotation of the drum 1 is projected on it by an image forming optical system 4. Through these process steps, an electrostatic image formed on the photosensitive member is developed into a toner image by an image developing device 5. The thus formed toner image corresponding to the original image O for reproduction is then transferred onto a reproduction paper P. This reproduction paper P is accommodated in a paper cassette C, and is forwarded from the paper cassette C between a pair of register rollers $7_1$, $7_2$ by means of a paper feeding roller 6 rotating in synchronism with rotation of the drum 1, and then sent out by the rollers $7_1$, $7_2$ to an image transfer position in such a manner that the front tip end of the paper P and the tip end of the toner image on the drum may be substantially coincided. Reference numerals $8_1$, $8_2$ and $9_1$, $9_2$ designate pairs of guide plates. At the image transfer position, the reproduction paper P is attracted to the peripheral surface of the photosensitive member by the action of an image transfer charger 10, when the toner image is transferred onto the paper P. After the image transfer, the paper P is separated from the photosensitive member by a separating means 11, conveyed on a belt 12, and then guided by a guide 13 into a press-contacting section of rollers 27, 32 in an image fixing device 14. (Details of this image fixing device 14 will be given at a later paragraph). After the fixing process of the toner image in this image fixing device, the paper P is discharged into a receiving tray. On the other hand, the photosensitive member is subjected to cleaning of residual toner by means of a cleaner 15 to be ready for the subsequent image processing cycle.

In the above-described conveying route of the reproduction paper P from the cassette C to the paper receiving tray T, if and when the paper gets clogged, a motor M which drives the drum 1, the rollers 6, $7_1$ and $7_2$, the belt 12, the image fixing rollers 27, 32, and the paper discharging rollers $48_1$, $48_2$ (to be detailed later) stops its rotation. These control means are well known. Upon stoppage of the motor M, an operator removes the paper clogged in the conveying path in a state of the abovementioned conveying means being stopped their operation. Incidentally, transmission of the driving force from the motor M to the abovementioned various control means 6, $7_1$, $7_2$, 12, 27, 32, $48_1$, $48_2$ and 3 is done by a well-known power transmission mechanism consisting of gear trains, a chain, a sprocket, a clutch, and so on.

Figure 2:
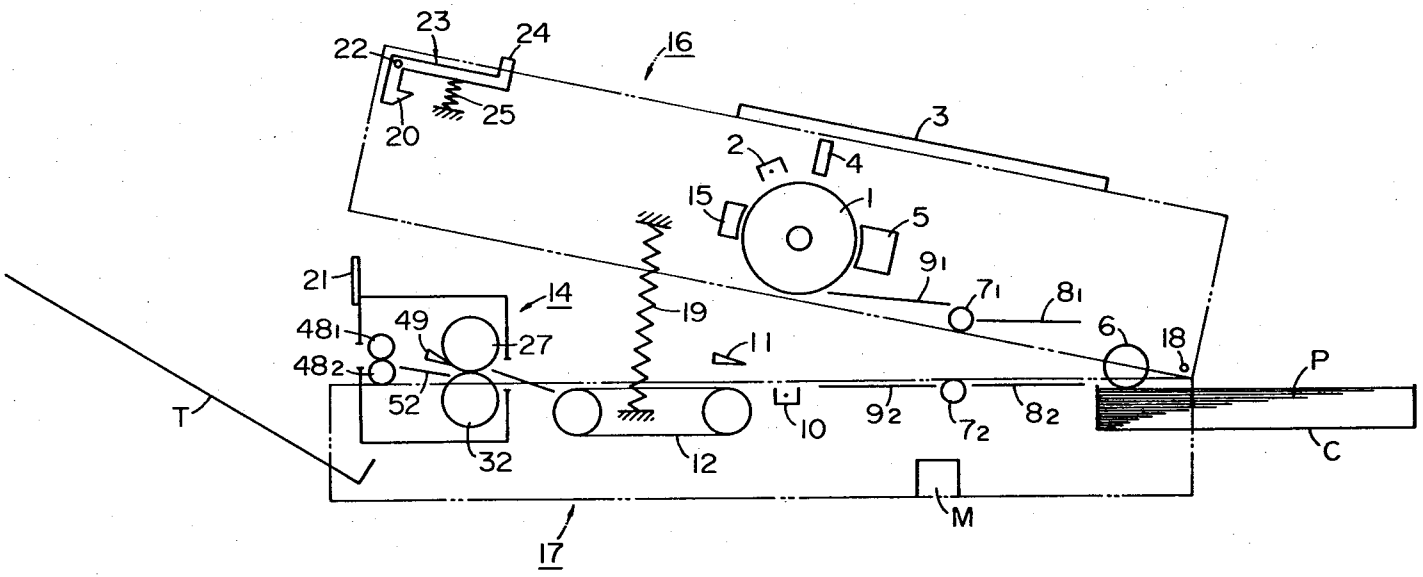
FIG. 2 is also a schematic side elevational view, in cross-section, of the embodiment shown in FIG. 1 which is in a state where an upper casing is raised upward from a lower casing.

In order to facilitate this removing work, the reproduction apparatus shown in FIG. 1 is so constructed that a main body casing which protects the abovementioned various control means disposed within the device, except for the image original mounting table 3, from external influence is divided into upper and lower portions, and the upper casing 16 is made freely openable and closable with respect to the lower casing 17. In more detail, the upper casing 16 is pivotally fixed at its one end part to the lower casing 17 through a shaft 18 in a manner to be able to freely open and close. The upper casing 16 is constantly given a rotational behaviour in the clockwise direction (in the drawing) with the shaft 18 as its center of oscillation by a compression spring 19, one end of which is connected to the upper casing and the other end of which is connected to the lower casing. This oscillatory movement, however, is prohibited by a hook 20 which is engaged with a hook hole formed in an operating knob 21 for releasing pressure in the image fixing rollers to be described later, when the device is in a state of being able to perform the reproduction operation, i.e., in a state as shown in FIG. 1 where the upper casing and the lower casing are closed together. When the paper P gets clogged somewhere in the conveying path, the operator disengages the hook 20 from the abovementioned hook hole in the knob 21, whereby the spring 19 causes the upper casing 16 to oscillate in the clockwise direction with the axis 18 as the center of its oscillation as shown in FIG. 2.

Various means 1, 2, 3, 4, 5, $8_1$, $7_1$, $9_1$, 15, and 20 are fixedly provided on the upper casing 16. On the other hand, various means 6, $8_2$, $7_2$, $9_2$, 10, 11, 12, 13, 14 and T are fixedly provided on the lower casing 17. Accordingly, in the state shown in FIG. 2, the paper conveying path from the paper cassette C to the image fixing device 14 wide opens, and the paper clogged in this part of the conveying path can be easily removed. Also, in case the paper is clogged in the image fixing device, it is removed by the operations to be described later.

The hook 20 is provided at one end of a lever 23 fixed on the upper casing 16 by a shaft 22 in a freely rotatable manner. At the other end of the lever 23, an operating button 24 is provided. The lever 23 is oscillatably energized in the counter-clockwise direction (in the drawing) by a compression spring 25, and is constantly given a rotational behaviour in the direction of its fitting with the hook hole in the abovementioned knob 21. The hook 20 disengages from the hook hole against the force of the spring 25 by depression of the button 24 by the operator. To close the upper casing 16 and the lower casing 17 together from the state shown in FIG. 2, the operator may manually push the upper casing downward, whereby the hook 20 contacts the knob 21 at its inclined surface, by the cam action of which the hook 20 automatically drops into the hole 21' of the knob 21. Further, the paper cassette C is provided on the lower casing 17 in a detachably attachable manner.

Figure 3:
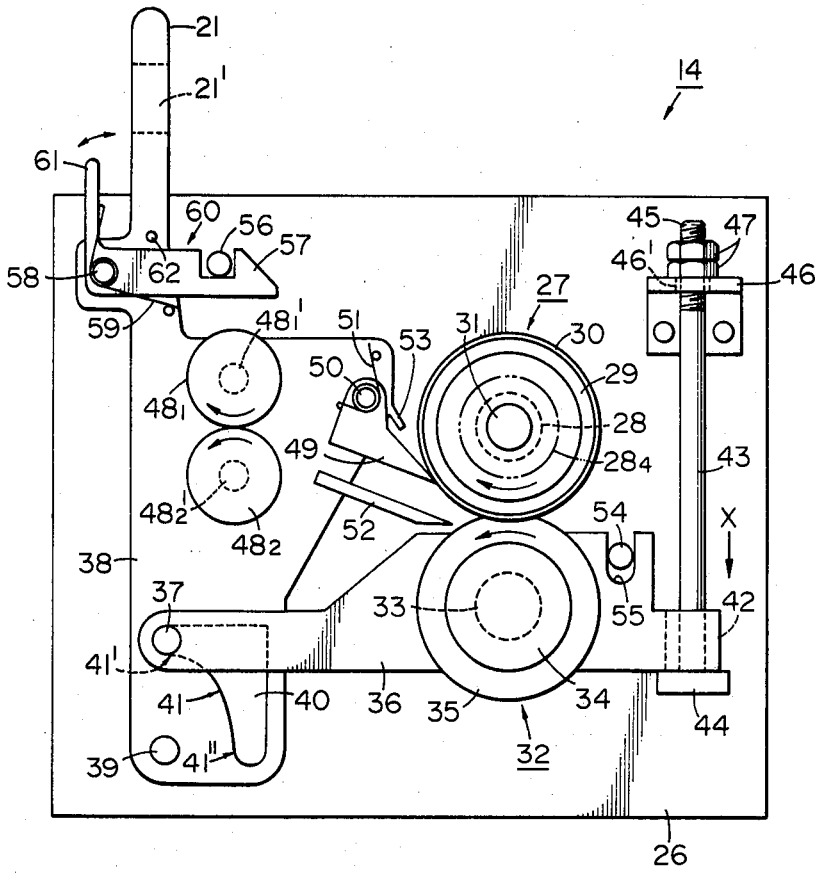
FIG. 3 is an explanatory diagram of an image fixing device used in the embodiment in FIG. 1, which is in an image fixing process mode for a reproduction paper.

FIG. 3 illustrates the image fixing device 14 in its state of being able to perform the image fixing operation, i.e., in its processing mode for image fixing on the paper P. In the drawing, a reference numeral 26 designates the side plate, on which an image fixing upper roller 27 where the toner image surface of the paper P is press-contacted is rotatably supported at a definite position. A numeral 28 refers to a shaft for the roller 27. The roller 27 is made of a hollow, cylindrical metal tube 29, the peripheral surface of which is coated with a thin layer 30 of tetrafluoroethylene resin, and the interior of which accommodates a heater 31. The surface of the roller 27 is heated by heat of the heater 31, whereby the toner of the toner image which is press-contacted to the roller surface melts to fix rigidly on the paper P.

Figure 4:
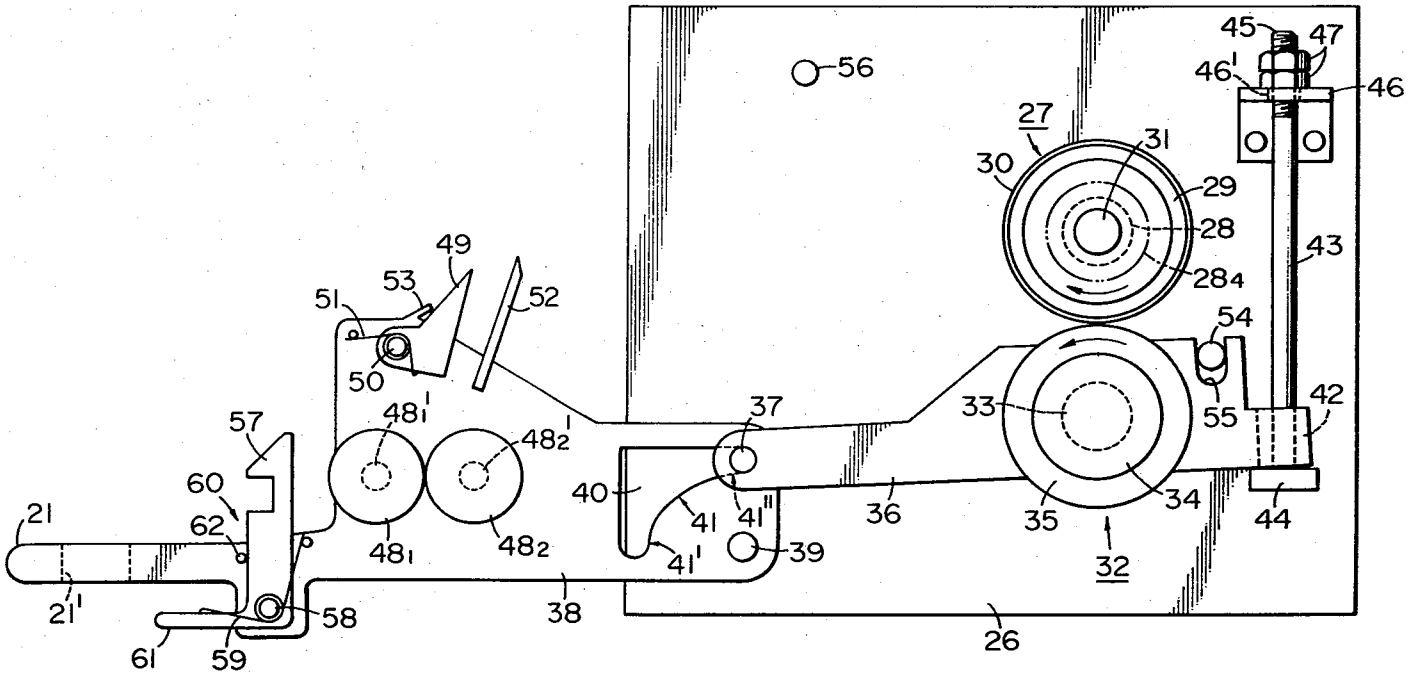
FIG. 4 is an explanatory diagram of the image fixing device in the embodiment in FIG. 1, which is in a removing process mode of the reproduction paper.
Figure 5:
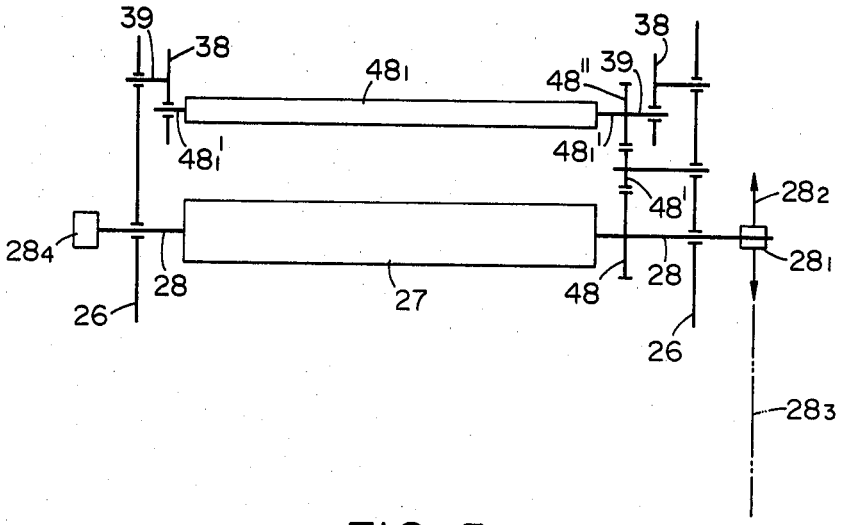
FIG. 5 is an explanatory diagram of a drive mechanism for the image fixing rollers and the paper discharging rollers.

As shown in FIG. 5, a one-way clutch $28_1$ is fitted on the end part of the shaft 28 fixed on the roller 27, and a sprocket $28_2$ is fixed on this one-way clutch $28_1$. A chain $28_3$ to transmit the rotational drive force from the motor M is extended on this sprocket $28_2$. On the other hand, at the other end part of the shaft 28, there is fixed a knob $28_4$ which can be manually rotated by the operator. Accordingly, when the rotational driving force from the motor M is transmitted to the sprocket $28_2$ through the chain $28_3$, this driving force is imparted to the shaft 28 through the clutch $28_1$, whereby the roller 27 rotates in the arrow direction in FIG. 3. On the other hand, when the power transmission from the motor M to the sprocket $28_2$ is interrupted, i.e., when the upper casing 16 is opened with respect to the lower casing 17 as shown in FIG. 2, the roller 27 rotates in the arrow direction in FIG. 3 or 4 by manual rotation of the knob $28_4$ by the operator. Rotation of the shaft 28 due to rotation of the knob $28_4$ is not transmitted to the sprocket $28_2$. This is due to the fact that the one-way clutch $28_1$ is interposed between the shaft 28 and the sprocket $28_2$. Therefore, the force required for the manual rotation of the roller 27 can be small. Incidentally, when the roller 27 is rotated by the motor and when it is rotated by manual operation, the roller 32 follows the rotation of the roller 27 by the frictional force therebetween.

A reference numeral 32 designates an image fixing lower roller. A shaft 33 for the roller is rotatably supported on a pressure applying lever 36. The roller 32 is formed by coating a thick layer of silicone rubber 35 on the peripheral surface of a metal core roll 34. This thick rubber layer 35 is elastically deformed when it is urged to the roller 27 by a mechanism to be described hereinbelow, at which time a nipping section (a press-contacting section) to convey the paper P between these rollers 27, 32 is formed.

A shaft 37 is fixed at one end of the pressure applying lever 36. The shaft 37 is engaged with a cam surface 41 of a hole 40 formed in an operating lever 38 which is pivotally fitted on the side plate 26 in a freely rotatable manner. As shown in FIG. 3, when the shaft 37 is engaged with the surface 41' of the cam surface 41, the roller 32 is urged toward the roller 27 with a relatively strong predetermined pressure, whereby the nipping section of a width sufficient to fix the toner image on the paper P, even when these rollers 27, 32 are rotated by the motor M at a relatively high predetermined speed, is formed between the rollers 27, 32. Incidentally, by the width of the abovementioned nipping section, it is meant the rotational direction of the rollers 27, 32, i.e., the width of the nipping section with respect to the conveying direction of the paper P.

Numerals $48_1$, $48_2$ refer to paper discharging rollers respectively fixed on shafts $48_1'$, $48_2'$, which are rotatably supported on the operating lever 38. When the roller $48_1$ is at a position shown in FIG. 3, it is associated with the roller 27 through a gear train, and rotated thereby. In other words, the gear train consists of a gear 48 fixed on the shaft 28 of the roller 27, a gear 48' rotatably supported on the side plate 26 and meshed with the gear 48, and a gear 48'' fixed on the shaft $48_1'$ of the roller $48_1$ and meshed with the gear 48'. When the shaft 28 is rotated, its rotational force is transmitted to the roller $48_1$ through the gears 48, 48' and 48'', and the roller $48_2$ follow the rotation of the roller $48_1$ due to the frictional force between them. In any case, the rollers $48_1$, $48_2$, when they are at their positions shown in FIG. 3, nip and convey the paper P forwarded from the rollers 27, 32 and discharge the same into the abovementioned tray T. In the state of FIG. 4, the gear 48'' separates from the gear 48'. A numeral 49 refers to a separating pawl and is rotatably supported by a shaft 50. The shaft 50 is fixedly provided on the operating lever 38.

The separating pawl 49 is oscillatably energized in the counter-clockwise direction (in the drawing) by a spring 51 and contacts the roller 27 lightly and elastically when it is at the position of FIG. 3, thereby separating from the roller 27 the paper which has passed through the nipping section of the rollers 27, 32. A reference numeral 52 designates a guide plate which is fixed on the lever 38. In the state of FIG. 3, the separating pawl 49 and the guide plate 52 constitutes a guide path to guide the toner image bearing paper sent out from the rollers 27, 32 into the paper discharging rollers $48_1$, $48_2$.

In the above-described image fixing device, the rollers 27, 32 remain under the abovementioned relatively strong predetermined pressure so far as no processing mode change-over operation by the knob 21 (to be detailed subsequently) is performed. In other words, unless the operator manually brings down the knob 21 as shown in FIG. 4, the abovementioned relatively strong pressure remains constantly between the roller 27, 32, irrespective of whether the reproduction apparatus is in its image forming operation or not, whether the main switch is "on" or "off", whether the paper P is held under pressure between the rollers 27, 32, or not, or whether the upper casing 16 is opened with respect to the lower casing 17, or not.

Therefore, the image information recording device according to the present invention, when it is compared with the device of a construction wherein the rollers 27, 32 are contacted and separated in correspondence to the image recording operations of the reproduction apparatus, is extremely simple in its construction, small in size, and least in getting into mechanical disorder, hence it is particularly useful for a small-sized reproduction apparatus. However, when it is found out as the result of opening the upper casing 16 with respect to the lower casing 17 that the paper has got clogged between the rollers 27, 32, the pressure exerted between the rollers 27, 32 is required to be reduced in comparison with the above-mentioned predetermined one. For this purpose, the operator manipulates the knob 21, depending on necessity, in a state of the upper casing 16 being opened with respect to the lower casing 17, to bring down the lever 38, on which the knob 21 is integrally fixed, by 90° in the counter-clockwise direction (in the drawing) with the shaft 39 as its center of oscillation.

Now, referring to FIG. 4, in the entire length of the cam surface 41 as mentioned above, a distance between the shaft 39 and the cam portion 41'' where the follower 37 is engaged when the lever 38 is laid down as shown in FIG. 4 is shorter than the distance between the shaft 39 and the cam portion 41' where the follower 37 is engaged when the lever 38 is upright as shown in FIG. 3. Accordingly, the lever 36 rotates in the counter-clockwise direction (in the drawing) on the pivot of a support 44, whereby the roller 32 displaces downward, i.e., in the direction of widening the axial distance between the rollers 27 and 32, and both rollers are brought to a state of light contact as shown in FIG. 4. At this instant, when the knob $28_4$ is manually rotated, the rollers 27, 32 rotate in the arrow direction, and the paper held between the rollers 27, 32 is discharged therefrom. At this instant, since the image bearing surface of the paper P has already received heat from the roller 27, to which it was contacted, and since the rotational speed of the rollers 27, 32 is slow due to manual rotation, the toner image carried on the paper P is firmly fixed thereon.

On the lever 38, there are fitted the supporting shafts $48_1'$, $48_2'$ for the paper discharging rollers $48_1$, $48_2$, the supporting shaft 50 for the pawl 49, and the guide plate 52. Accordingly, when the lever 38 is laid down as shown in FIG. 4, the rollers $48_1$, $48_2$ the pawl 49, and the guide plate 52 are withdrawn outside from the conveying path of the paper P to a considerable extent, whereby a large space is formed behind the rollers 27, 32 (with respect to the paper conveying direction) as shown in FIG. 4. As a result, the paper stopped between the rollers 27, 32 can be readily removed. Furthermore, removal of the paper which has passed through the rollers 27, 32, but has become clogged at the rollers $48_1$, $48_2$ is also very easy. Incidentally, the pawl 49 is given an oscillatory behaviour in the counter-clockwise direction by the spring 51, but its oscillation is restricted by a stopper 53 fixed on the lever 38. Also, the positions of the lever 38 at its upright and laid-down positions are respectively determined by its engagement with the shaft follower 37 and the end part of the hole 40 in the lever 38. It should be noted here that, for the sake of convenience, the state as shown in FIG. 3 is called "the image fixing process mode of the paper P", while the state as shown in FIG. 4 is called "the removal process mode of the paper P".

A reference numeral 56 designates a pin which is studded on the side plate 26. This pin 56 is engaged with the hook 57 when the lever 38 is upright so as to prevent it from laying down unexpectedly (vide: FIG. 3). The hook 57 is formed at one end part of a lever 60 which is rotatably fitted on the lever 38 through a shaft 58 and is given an oscillatory behaviour in the counter-clockwise direction by a spring 59. The other end of the lever 60 forms an operating knob 61 which, when the operator displaces it manually in the clockwise direction, causes the hook 57 to be disengaged from the pin 56. When the operator turns the knob 21, which is in its displaced position as mentioned above, in the counter-clockwise direction, the lever 38 lays down as shown in FIG. 4. In this instance, the oscillation of the lever 60 due to the spring 59 is hindered by a pin 62 studded in the knob 21. In order to engage the hook 57 on the pin 56 again, the knob 21 may be moved to its upright position in the clockwise direction. In this case, the oblique surface of the hook 57 contacts the pin 56, and, by the cam action of this oblique surface, the hook 57 is oscillated until it becomes engaged with the pin.

A reference numeral 21' designates a hole formed in the knob 21, with which the hook 20 shown in FIGS. 1 and 2 is engaged. Therefore, in the paper removing process mode in FIG. 4, it is not possible to engage the hook 20 with the hook hole 21', hence the upper casing 16 of the device main body cannot be closed toward the lower casing 17, i.e., the reproduction operation by the device cannot be resumed. In other words, with the embodimental device according to the present invention, the trouble such that the upper casing 16 is closed without imparting a predetermined pressure between the rollers 27, 32 can be perfectly avoided.

When the reproduction paper P gets clogged in the conveying path, and the reproduction device stops its operation, the upper casing 16 is first opened as already explained in reference to FIGS. 1 and 2, thereby removing the paper clogged in the paper conveying path after the roller 6 and before the image fixing device 14. When the paper is blocked in the image fixing device 14, the lever 38 is first laid down in a manner as shown in FIGS. 3 and 4. In this instance, the space around the rollers 27, 32 and thereafter opens wide, and, at the same time, the pressure between the rollers is reduced, whereby the paper which has passed through the rollers 27, 32, but blocked at the rollers $48_1$, $48_2$ can be readily removed at once. The paper clogged between the rollers 27, 32 can be easily taken away by the operator when he manually turns the knob $28_4$ (this rotation of the knob is made very light).

In the above-described embodiment, the roller 32 is in contact with the roller 27 even in the paper removing process mode of the device. However, in this processing mode, it is also feasible that the roller 32 be separated from the roller 27 with a short distance, in which case it is only sufficient that the distance between the cam surface 41" and the shaft 39 be made a bit smaller than that as shown in FIGS. 3 and 4. In case the roller 32 is separated from the roller 27 in the paper removing process mode, the paper P can be removed from between the rollers 27, 32 either by manually rotating the roller 30, or by the operator when he holds the edge of the paper with his fingers and draws it out.

Figure 6:
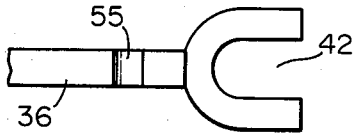
FIG. 6 is an explanatory diagram of one part of a roller supporting lever.

The pressure between the rollers 27, 32 in the processing mode shown in FIG. 3, and the pressure between them in the processing mode in FIG. 4 can be adjusted by the following mechanism. At one end part of the lever 36 opposite to the end where the shaft 37 is provided with respect to the shaft 33, there is formed a U-shaped or fork member 42, as viewed from the direction of X in FIG. 3, with its outward end being open (vide: FIG. 6). The end part of the lever 36 having the U-shaped member 42 is slightly loosely fitted with an adjusting rod 43 through the open end of the U-shaped member. At the bottom end of the adjusting rod 44, there is provided a supporting member 44 of a larger diameter than the rod 43, on the top surface of which rests the abovementioned end part of the lever 36. On the other hand, a screw 45 is formed at the top end part of the rod 43. This screw part 45 is loosely inserted into a hole 46' formed in a bracket 46 fixed on the side plate 26. Two pieces of nut 47 are screw-engaged with the threaded portion of the adjusting rod 43 in a manner to press-contact on the top surface of the bracket 46. When the nuts 47 are rotated, the supporting member 44 at the bottom end of the adjusting rod 43 moves up and down, whereby the lever 36 is oscillated with the shaft 37 as the pivot to adjust the position of the rollers 27, 32, hence the pressure to be applied between them.

A reference numeral 54 designates a pin studded in the side plate 26, with which a U-shaped notch 55 formed in the lever 36 is engaged when at least the roller 32 is at its position shown in FIGS. 3 and 4. By this engagement, the displacement of the roller 32 to the left and right directions in the drawing is prevented, and the roller 32 displaces only in the up and down directions by the standing-up and laying-down of the lever 38. However, when the nuts 47 are further loosened in the state of FIG. 4, and the adjusting rod 43, hence the supporting member 44, is lowered, the notch 55 also lowers to get off below the pin 54. On the other hand, the hole 40 in the lever 38 is formed in such a shape that the shaft 37 is separated from the cam surface 41 to be able to displace in the left direction in the drawing. The right end of the lever 36 is in U-shape 42 with its right end being open. Accordingly, when the roller 32 is slightly moved leftward in the drawing along with the lever 36, after the notch 55 is removed from the pin 54 as mentioned above, the lever 36 and the roller 32 can be easily removed from the image fixing device, which facilitates repair and replacement of the roller 32 which is liable to be worn. Fitting of the roller 32 to the image fixing device is also easy by the operations just opposite to the abovementioned.

The present invention is applicable to the image recording devices which utilize not only an image original for reproduction as the image informations, but also a light beam modulated by a light output from a cathode ray tube, discharge output from a pin tube, and an electrical output from a signal source, an electric resistance pattern formed in advance on the photographic base plate, and others.

What I claim is:

1. An image forming apparatus, comprising:

image forming means for forming on an image bearing material an image corresponding to an image to be recorded;

first and second rollers for forming a nip therebetween through which the image bearing material is passed to fix the image on the image bearing material;

first displacing means for displacing said second roller between a first position wherein it is press-contacted to said first roller and a second position wherein it is disengaged from said first roller or contacted thereto with reduced pressure;

means for guiding in a predetermined direction the image bearing material which has passed through the nip;

second displacing means for displacing said guiding means between a first position wherein it guides the image bearing material in said predetermined direction and a second position wherein it is at rest; and means for changing the mode of processing the image bearing material, said mode changing means engaging said first displacing means and said second displacing means to interrelate their respective displacements and thereby to cause simultaneous displacements of said second roller to its second position and of said guiding means to its rest position.

2. An apparatus according to claim 1, wherein said first displacing means is engaged with pressure adjusting means for adjusting the pressure between said first and second rollers.

3. An apparatus according to claim 2, wherein said first displacing means is detachably engaged with said pressure adjusting means.

4. An apparatus according to claim 2 or 3, wherein said pressure adjusting means includes threaded screw means, one end of which is engaged with a holding member disposed at a fixed position, and the other end of which is engaged with said first displacing means.

5. An apparatus according to claim 1, 2 or 3, wherein said mode changing means has a cam surface with which said first displacing means is engaged.

6. An apparatus according to claim 1, 2 or 3, wherein said mode changing means has a manually operable knob.

7. An apparatus according to claim 6, further comprising:

first and second covering means to cover the interior of said apparatus, wherein said second covering means can be selectively opened and closed relative to said first covering means, and wherein said mode changing means has engaging means to engage said second covering means closed to said first covering means when said mode changing means is in a state with said first and second displacing means at their respective first positions; and disengaging means to disengage said engagement when said second covering means is opened to said first covering means.

8. An apparatus according to claim 7, wherein said second covering means can be opened and closed up and down with respect to said first covering means, said image forming means being mounted on said second covering means, and said first roller, first and second displacing means, and mode changing means being mounted on said first covering means.

9. The device according to claim 1, 2 or 3, further comprising:

heating means to heat at least one of said first and second rollers; and manual rotating means to manually rotate at least one of said first and second rollers, when said first displacing means is at the second position, said second roller being in press-contact with said first roller when said first displacing means is at the second position.

10. The device according to claim 1, 2 or 3, wherein said guide means includes a separating member which selectively contacts to, or separates from, at least one of said first and second rollers by the operation of said mode changing means, said separating member constituting an image bearing member discharging path when it contacts with at least one of said first and second rollers to thereby separate the image bearing member from said rollers.

11. The device according to claim 1, 2 or 3, wherein said guide means includes at least a pair of paper discharging rollers which are selectively displaceable between the first and second positions by the operation of said mode changing means, said pair of paper discharging rollers, when they are at their first position, holding and conveying the image bearing member which has passed through said first and second rollers.

12. An image forming apparatus, comprising:

image forming means for forming on an image bearing material an image corresponding to an image to be recorded;

first and second rollers for forming a nip therebetween through which the image bearing material is passed to fix the image on the image bearing material;

first displacing means for displacing said second roller between a first position wherein it is press-contacted to said first roller and a second position wherein it is disengaged from said first roller or contacted thereto with reduced pressure;

means for guiding in a predetermined direction the image bearing material which has passed through the nip;

second displacing means for displacing said guiding means between a first position wherein it guides the image bearing material in said predetermined direction and a second position wherein it is at rest;

means for changing the mode of processing the image bearing material, said mode changing means engaging said first displacing means and said second displacing means to interrelate their respective displacements and thereby to cause simultaneous displacements of said second roller to its second position and of said guiding means to its rest position; and locking means for locking said first displacing means when said second roller is at its first position, and locking said second displacing means when said guiding means is at its first position.

13. An apparatus according to claim 12, wherein said first displacing means is engaged with pressure adjusting means for adjusting the pressure between said first and second rollers.

14. An apparatus according to claim 13, wherein said first displacing means is detachably engaged with said pressure adjusting means.

15. An apparatus according to claim 13 or 14, wherein said pressure adjusting means includes threaded screw means, one end of which is engaged with a holding member disposed at a fixed position, and the other end of which is engaged with said first displacing means.

16. An apparatus according to claim 12, 13 or 14, wherein said mode changing means has a manually operable knob.

17. The device according to claim 12, 13 or 14, wherein said mode changing means has a cam surface with which said first displacing means is engaged.

18. An apparatus according to claim 17, further comprising:

first and second covering means to cover the interior of said apparatus, wherein said second covering means can be selectively opened and closed relative to said first covering means, and wherein said changing means has engaging means to engage said second covering means closed to said first covering means when said first and second displacing means are locked by said locking means; and disengaging means to disengage said engagement when said second covering means is opened to said first covering means.

19. An apparatus according to claim 18, wherein said second covering means can be opened and closed up and down with respect to said first covering means, said image forming means being mounted on said second covering means, and said first roller, first and second displacing means, and mode changing means being mounted on said first covering means.

20. An apparatus according to claim 12, 13 or 14, further comprising:

heating means to heat at least one of said first and second rollers; and manual rotating means to manually rotate at least one of said first and second rollers, when said first holding means is at the second position, said second roller being in press-contact with said first roller when said first displacing means is at its second position.

21. An apparatus according to claim 12, 13 or 14, wherein said guide means includes a separating member which selectively contacts to, or separates from, at least one of said first and second rollers by the operation of said mode changing means, said separating member constituting an image bearing member discharging path when it contacts with at least one of said first and second rollers to thereby separate the image bearing member from said rollers.

22. An apparatus according to claim 12, 13 or 14, wherein said guide means includes at least a pair of paper discharging rollers which are selectively displaceable between their first and second positions by the operation of said mode changing means, said pair of paper discharging rollers, when they are at their first position, holding and conveying the image bearing member which has passed through said first and second rollers.

23. An image forming apparatus which is divisible into a first body and a second body movable between open and closed positions, comprising:

image forming means for forming on an image bearing material an image corresponding to an image to be recorded;

first and second rollers for forming a nip therebetween through which the image bearing material is passed to fix the image on the image bearing material;

displacing means for displacing said second roller between a first position where it is press-contacted to said first roller and a second position wherein it is disengaged from said second roller or contacted thereto with reduced pressure;

locking means locking said first body and said second body together in said closed position; and means for preventing said locking by said locking means when said second roller is displaced to said second position by said displacing means.

24. An apparatus according to claim 23, wherein said displacing means is engaged with pressure adjusting means for adjusting the pressure between said first and second rollers.

25. An apparatus according to claim 24, wherein said displacing means is detachably engaged with said pressure adjusting means.

26. An apparatus according to claim 24 or 25, wherein said pressure adjusting means includes threaded screw means, one end of which is engaged with a holding member disposed at a fixed position, and the other end of which is engaged with said displacing means.

27. An apparatus according to claim 23, further comprising:

heating means to heat at least one of said first and second rollers; and manual rotating means to manually rotate at least one of said first and second rollers, when said displacing means is at the second position, said second roller being in press-contact with said first roller when said displacing means is at the second position.

* * * * *